US005403361A

United States Patent [19]

Schrell et al.

[11] Patent Number: 5,403,361

[45] Date of Patent: Apr. 4, 1995

[54] PROCESS FOR DYEING FIBER MATERIALS MODIFIED WITH SILANES, THE MODIFICATION OF FIBERS MATERIALS WITH SILANE COMPOUNDS, AND SILANES CONTAINING AMINO GROUPS

[75] Inventors: Andreas Schrell, Coesfeld; Werner H. Russ, Flörsheim am Main; Thomas Riehm, Hattersheim am Main; Tilo Vaahs, Kelkheim, all of Germany

[73] Assignee: Hoechst AG, Frankfurt, Germany

[21] Appl. No.: 105,472

[22] Filed: Aug. 12, 1993

Related U.S. Application Data

[63] Continuation of Ser. No. 880,508, May 8, 1992, abandoned.

[30] Foreign Application Priority Data

| | | | |
|---|---|---|---|
| May 11, 1991 | [DE] | Germany | 41 15 461.4 |
| Mar. 14, 1992 | [DE] | Germany | 42 08 212.9 |
| Mar. 28, 1992 | [DE] | Germany | 42 10 270.7 |
| Mar. 28, 1992 | [DE] | Germany | 42 10 271.5 |

[51] Int. Cl.[6] ..... C09B 67/00; D06P 3/00

[52] U.S. Cl. ..... 8/581; 8/532; 8/534; 8/543; 8/609; 8/918; 8/922; 8/927; 8/930

[58] Field of Search ..... 8/543, 581, 918, 532, 8/534, 609, 922, 927, 930

[56] References Cited

U.S. PATENT DOCUMENTS

| | | | |
|---|---|---|---|
| 3,504,998 | 4/1970 | Speier | 8/581 |
| 3,512,915 | 5/1970 | Speier | 8/8 |
| 3,653,952 | 4/1972 | Gagliardi | 428/266 |
| 4,496,363 | 1/1985 | DeFilippi | 8/127.6 |
| 5,114,760 | 5/1992 | Takemura et al. | 8/495 |

FOREIGN PATENT DOCUMENTS

| | | |
|---|---|---|
| 1294236 | 4/1962 | France . |
| 1294237 | 4/1962 | France . |
| 154020 | 2/1982 | German Dem. Rep. . |
| 1186061 | 6/1970 | Germany . |
| 939227 | 10/1963 | United Kingdom . |
| 1174433 | 7/1967 | United Kingdom . |

OTHER PUBLICATIONS

*Fairchild's Dictionary of Textiles,* citations "glass fiber" and glass textile, 1959, pp. 256–257.

*Primary Examiner*—Linda Skaling
*Assistant Examiner*—Caroline L. Dusheck
*Attorney, Agent, or Firm*—Connolly and Hutz

[57] ABSTRACT

A process for dyeing textile fiber materials with water-soluble dyestuffs, in particular anionic dyestuffs, and of these in particular those having a fiber-reactive group, in which the dyeing is carried out using low-electrolyte or entirely electrolyte-free and/or low-alkali or entirely alkali-free dye liquors or printing pastes and a fiber material which has been modified with a silane compound containing amino groups is used as the textile material. The fiber material is modified by applying the silane compound containing amino groups to the material in aqueous solution and subjecting the impregnated material to a heat treatment. Novel silane compounds which contain a secondary amino group and can likewise be employed for the purpose mentioned are furthermore described.

15 Claims, No Drawings

PROCESS FOR DYEING FIBER MATERIALS MODIFIED WITH SILANES, THE MODIFICATION OF FIBERS MATERIALS WITH SILANE COMPOUNDS, AND SILANES CONTAINING AMINO GROUPS

This application is a continuation of application Ser. No. 07/880,508, filed May 8, 1992, and now abandoned.

The large amounts of salt and/or alkali which are required when dyeing textiles in order to increase the substantivity of water-soluble textile dyestuffs and are liberated after completion of the dyeing, with the associated environmental pollution, were the reason for seeking a novel process which allows the amounts of these necessary additives to be reduced drastically or for these additives to be dispensed with entirely. Although alkali can be neutralized in the wastewater from the dyeing, this means that additional salts enter the wastewater, from which they can no longer be removed. The object of the present invention was therefore to discover a process for dyeing all types of textile fiber materials, such as naturally occurring and synthetic fiber materials, for example polyacrylonitrile and polyester fiber materials, as well as fiber materials of natural and synthetic origin which contain hydroxy and/or carboxamide groups, such as fiber materials of polyamide 4, polyamide 6 and polyamide 11, silk, wool and other animal hair, and in particular fiber materials which contain the parent substance of $\alpha$- and/or $\beta$-glucose, such as cellulose fiber materials, for example cotton, hemp, jute and linen, or synthetic and regenerated derivatives thereof, such as cellulose acetate, viscose silk and viscose staple, which can be carried out with only the smallest possible amounts of electrolyte salts, such as sodium chloride and sodium sulfate, or entirely without electrolyte salts and at the same time with only small amounts of an alkaline agent, such as sodium carbonate, sodium hydroxide or water-glass, or entirely without such an alkaline agent. The use of alkaline agents is necessary in particular for fixing the industrially important reactive dyestuffs to the fiber. A dyeing process which can be carried out with a low addition of salt or entirely without salt and at the same time using only small amounts of an alkaline agent or entirely without such an alkaline auxiliary is therefore of particular advantage in dyeing processes using fiber-reactive dyestuffs, since in addition to the fixing operation of the fiber-reactive dyestuff in the aqueous, often strongly alkaline dye liquor, hydrolysis reactions can additionally proceed on the fiber-reactive dyestuff, which is why fixing to the fiber material is not complete. For this reason, after the dyeing process, in some cases extensive and time-consuming washing and rinsing processes must be carried out, such as rinsing with cold and hot water several times and an intermediate neutralization treatment to remove excess alkali on the dyed material, and furthermore, for example, washing at the boil with a nonionic detergent in order to guarantee good fastness properties of the dyeing.

It has now been found that dyeings from water-soluble textile dyestuffs, in particular fiber-reactive dyestuffs, are surprisingly obtained with a uniform color shade and good depth of color and with good fabrication and use fastnesses if a fiber material which has been modified with a silane compound, with the proviso that at least one of the substituents bonded to the silicon atom, for example alkyl, alkoxy and phenyl radicals, has a primary, secondary or tertiary amino group, a primary, secondary, tertiary or quaternary ammonium group or a hydroxy or thiol group, where these substituents can also be substituted by other nonionic and/or anionic substituents, and with the proviso that at least one of the substituents bonded to the silicon atom is a substituent which is hydrolyzed by water to give the hydroxy group. The alkyl and alkoxy substituents are preferably those having 1 to 8 carbon atoms. The use of this fiber material modified with such a silane compound allows the dyeing process (by which there are also understood printing processes) to be carried out using low-electrolyte and low-alkali or even electrolytefree and alkali-free dye liquors, for which reason the expensive aftertreatment of the dyeings by rinsing and boiling processes can also be dispensed with.

The present invention therefore relates to a process for dyeing (including printing) textile fiber materials with water-soluble dyestuffs, in particular anionic dyestuffs, which comprises carrying out the dyeing using low-electrolyte or entirely electrolyte-free and/or low-alkali or entirely alkali-free dye liquors (including printing pastes), and using a fiber material modified with an abovementioned silane compound as the textile material.

Fiber materials which are modified according to the invention and can be employed according to the invention in dyeing processes are all the abovementioned synthetic and naturally occurring fiber materials modified with those silanes. The present invention therefore also relates to textile fiber materials modified with those silanes.

Silane compounds which are used according to the invention for modification of the fiber materials are, for example, those which correspond to the formula (1)

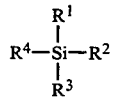

(1)

in which:

$R^1$ is alkoxy having 1 to 8 carbon atoms, preferably 1 to 4 carbon atoms, such as methoxy and ethoxy, hydrogen, halogen, such as chlorine and bromine, hydroxy , alkoxy having 2 to 4 carbon atoms, preferably ethoxy, which is substituted by alkoxy having 1 to 4 carbon atoms, preferably methoxy and ethoxy, N-morpholino, N-imidazolino or a group of the formula (2)

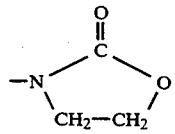

(2)

preferably alkoxy having 1 to 4 carbon atoms and alkoxy having 2 to 4 carbon atoms which is substituted by alkoxy having 1 to 4 carbon atoms;

$R^2$ is a group of the formula (3a) or (3b)

$$\left[A-X^1\right]_a\left\{\left[B-X^2\right]_b D-T\right\}_c \quad (3a)$$

-continued $$\text{-}[A-X^1]_a[B-X^2]_b D-NH-G-\underset{R^9}{\overset{R^1}{Si}}-R^8 \quad (3b)$$

wherein:

a is the number zero or 1;

b is an integer from zero to 10, preferably zero or 1 to 5 and in particular zero or 1 to 3;

c is the number 1 or 2, and is necessarily 1 if a is zero;

the sum of (a+b) is preferably 1 or greater than 1, particularly preferably 1, 2, 3 or 4;

A is alkylene having 1 to 6 carbon atoms, preferably having 2 to 4 carbon atoms, which can be substituted by hydroxy, methoxy, ethoxy, sulfo, sulfato or carboxy, or is phenylene, which can be substituted by methoxy, ethoxy, methyl, ethyl, sulfo and/or carboxy, or is phenylene-alkylene, alkylene-phenylene, alkylene-phenylene-alkylene or phenylene-alkylene-phenylene, in which the alkylene groups of these radicals are those having 1 to 6 carbon atoms, preferably having 1 to 4 carbon atoms, and can be substituted by hydroxy, methoxy, ethoxy, sulfo, sulfato or carboxy, and the phenylene radicals can be substituted by methoxy, ethoxy, methyl, ethyl, sulfo and/or carboxy;

$X^1$ in the case where c is 1 is a group of the formula —S—, —O—, —NH— or —N(R)—, in which R is alkyl having 1 to 4 carbon atoms, such as methyl or ethyl, and is preferably a group of the formula —O— or —NH—, or in the case where c is 2 is a nitrogen atom;

B is cycloalkylene having 5 to 8 carbon atoms, such as cyclohexylene and cyclopentylene, or alkylene having 1 to 6 carbon atoms, preferably having 1 to 4 carbon atoms, in particular 2 or 3 carbon atoms, which can be substituted by hydroxy, methoxy, ethoxy, sulfato, sulfo or carboxy, or is phenylene, which can be substituted by methoxy, ethoxy, methyl, ethyl, sulfo and/or carboxy, preferably alkylene having 2 to 4 carbon atoms;

$X^2$ is a group of the formula —S—, —O—, —NH— or —N(R)—, where R has the abovementioned meaning, and preferably —O— or —NH—;

D is alkylene having 1 to 6 carbon atoms, preferably having 2 to 4 carbon atoms, which can be substituted by hydroxy, methoxy, ethoxy, sulfo, sulfato or carboxy, or is phenylene, which can be substituted by methoxy, ethoxy, methyl, ethyl, sulfo and/or carboxy, or is phenylene-alkylene, alkylene-phenylene, alkylene-phenylene-alkylene or phenylene-alkylene-phenylene, in which the alkylene groups of these radicals are those having 1 to 6 carbon atoms, preferably having 1 to 4 carbon atoms, and can be substituted by hydroxy, methoxy, ethoxy, sulfo, sulfato or carboxy,, and the phenylene radicals can be substituted by methoxy, ethoxy, methyl, ethyl, sulfo and/or carboxy, or D can be a direct bond, if (a+b) is not zero, and is preferably alkylene having 2 to 4 carbon atoms or a direct bond in the case where (a+b) is 1 or greater than 1;

T is hydroxy , thiol or preferably a group of the formula (4a) or (4b), in particular of the formula (4a)

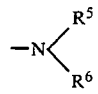

(4a)

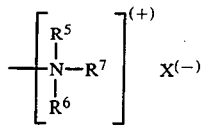

(4b)

in which $R^5$ is hydrogen or alkyl having 1 to 4 carbon atoms, which can be substituted by phenyl, sulfophenyl, amino, thio or hydroxy, or is carbamoyl, which can be mono- or disubstituted, such as, for example, by substituents from the group comprising alkyl having 1 to 4 carbon atoms, phenyl, sulfophenyl, cycloalkyl having 5 to 8 carbon atoms and alkyl having 2 to 4 carbon atoms, which is substituted by amino, thio or hydroxy, $R^6$ is hydrogen, phenyl, sulfophenyl or alkyl having 1 to 4 carbon atoms, which can be substituted by phenyl, sulfophenyl, methoxy, ethoxy, amino, thio or hydroxy, $R^7$ is hydrogen, alkyl having 1 to 4 carbon atoms, which can be substituted, such as, for example, by hydroxy, amino, thio, carboxy or sulfo, or is alkenyl having 2 to 6 carbon atoms, preferably having 2 to 4 carbon atoms, and $X^{(-)}$ is a monovalent anion or a portion of a polyvalent anion equivalent to a monovalent anion;

G is a radical of the formula (5)

$$-D-[X^2-B]_b[X^1-A]_a \quad (5)$$

in which D, $X^2$, B, $X^1$, A, a and b have one of the abovementioned, particularly preferred, meanings;

$R^8$ is alkoxy having 1 to 8 carbon atoms, preferably having 1 to 4 carbon atoms, such as ethoxy and methoxy, alkyl having 1 to 8 carbon atoms, preferably having 1 to 4 carbon atoms, such as ethyl and methyl, alkenyl having 2 to 8 carbon atoms, preferably having 2 to 4 carbon atoms, or phenylene-alkyl with an alkyl radical having 1 to 4 carbon atoms, in which the phenylene radical can be substituted by substituents from the group comprising methyl, ethyl, methoxy, ethoxy, sulfo and carboxy, and in which these radicals $R^8$ can also be substituted by a group T having the above meaning;

$R^9$ has one of the meanings of $R^1$ or $R^3$;

$R^3$ is alkoxy having 1 to 8 carbon atoms, preferably having 1 to 4 carbon atoms, such as ethoxy and methoxy, hydrogen, halogen, such as chlorine and bromine, hydroxy, alkyl having 1 to 8 carbon atoms, preferably having 1 to 4 carbon atoms, such as ethyl and methyl, alkenyl having 2 to 8 carbon atoms, preferably having 2 to 4 carbon atoms, alkinyl having 3 to 8 carbon atoms, preferably having 3 to 5 carbon atoms, or phenyl or a group of the general formula (3a) or (3b), preferably alkyl having 1 to 4 carbon atoms, alkoxy having 1 to 4 carbon atoms, alkoxy having 2 to 4 carbon atoms which is substituted by alkoxy having 1 to 4 carbon atoms, or a group of the general formula (3a) or (3b); and $R^4$ has one of the meanings given for $R^1$ or $R^3$.

The radical of the formula (5) and the radical of the formula $-[A-X^1)_a-[B-X^2]_b-D-$ corresponding to this in formula (3a) is preferably a radical of the formula (6a), (6b), (6c), (6d), (6e), (6f), (6g), (6h), (6i) or (6j), and of these preferably a radical of the general formula (6c), (6d), (6e), (6f), (6h), (6i) or (6j):

(6a)

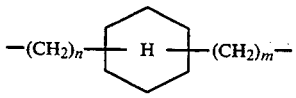

(6b)

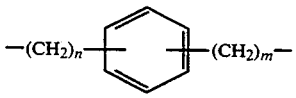

$-(CH_2)_n-O-(CH_2)_m-$ (6c)

$-(CH_2)_n-O-(CH_2)_m-CH(OH)-CH_2-$ (6d)

(6e)

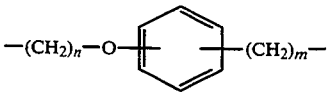

$-(CH_2)_n-NH-(CH_2)_m-$ (6f)

$-(CH_2)_n-S-(CH_2)_m-$ (6g)

(6h)

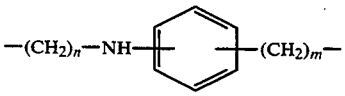

(6i)

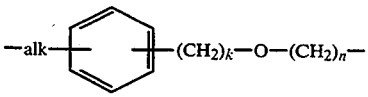

$-(CH_2)_n\text{-}[O-(CH_2)_p]_z-$ (6j)

in which n is an integer from 1 to 6, preferably from 2 to 4, m is an integer from zero to 6, preferably from 1 to 4, k is an integer from zero to 4, preferably 1 or 2, p is an integer from 1 to 4, preferably 2 or 3, z is an integer from 1 to 10, preferably 1 to 5 and in particular 1, and alk is a straight-chain or branched alkylene radical having 1 to 8 carbon atoms, the branched alkylene radical preferably being a radical of the formula $$-(CH_2)_r-\underset{\underset{R^*}{|}}{CH}-$$

in which r is an integer from 1 to 4 and R* is alkyl having 1 to 3 carbon atoms.

$R^5$ is preferably hydrogen, alkyl having 1 to 3 carbon atoms, such as methyl and ethyl, or cyclohexyl, and particularly preferably hydrogen, methyl or ethyl, especially hydrogen. $R^6$ is preferably hydrogen, alkyl having 1 to 4 carbon atoms, in particular methyl and ethyl, phenyl or alkyl having 2 to 4 carbon atoms which is substituted by methoxy or ethoxy, and of these less preferably hydrogen. The group of the formula (4a) is preferably a secondary amino group, such as, in particular, the methylamino or ethylamino group.

Other silane compounds which can be used according to the invention are, for example, polymeric silane compounds, such as siloxanes and polyethyleneimines which are substituted by at least one silane radical, such as, for example, polyethyleneimines of 2 to 5 ethyleneimine units, 1 to 3 amino groups of which are substituted by a radical of the formula (7)

$$-G-\overset{\overset{R^1}{|}}{\underset{\underset{R^9}{|}}{Si}}-R^8 \qquad (7)$$

in which G, $R^1$, $R^8$ and $R^9$ have one of the abovementioned, particularly preferred, meanings, G preferably being a radical of the formula (6a) to (6f), (6i) and (6j). Polymeric siloxanes are those which are derived from disiloxane or from siloxanes having 3 to 5 silicon atoms, in which the silicon atoms are substituted by the radicals $R^2$ $R^2$ and $R^9$ the radical $R^2$ preferably in each case being bonded to the terminal silicon atoms.

The alkyl, alkenyl and alkylene radicals mentioned for the above formula radicals can be straight-chain or branched. The individual formula radicals can have meanings which are identical to one another or different from one another within the context of their stated meaning.

Hydrolyzable substituents bonded to the silicon atom are for example hydrogen atoms, halogen atoms, alkoxy, phenoxy, amino and amide radicals, such as, for example, those mentioned initially for formula radical $R^1$.

The silane compounds used according to the invention are described in numerous instances in the literature and in some cases are commercially available. Silane compounds which are not known as a species can be synthesized by procedures analogous to those for the preparation of the known silane compounds, such as, for example, analogously to the data in German Patent No. 1 186 061. Novel silane compounds corresponding to the formula (1) which can be used according to the invention and are to be singled out in particular are those which contain a secondary amino group and which correspond to the formula (8)

$$R^{14}-\overset{\overset{R^1}{|}}{\underset{\underset{R^{13}}{|}}{Si}}-R^{12} \qquad (8)$$

in which $R^1$ has one of the abovementioned meanings, $R^{12}$ is a group of the formula (9a) or (9b)

(9a)

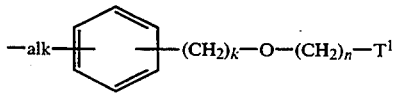

$-(CH_2)_n\text{-}[O-(CH_2)_p]_z-T^1$ (9b)

in which n is an integer from 1 to 6, preferably from 2 to 4, m is an integer from zero to 6, preferably from 1 to 4, k is an integer from zero to 4, preferably 1 or 2, p is an integer from 1 to 4, preferably 2 or 3, z is an integer from 1 to 10, preferably 1 to 5 and in particular 1, and alk is a straight-chain or branched alkylene radical having 1 to 8 carbon atoms, the branched alkylene radical preferably being a radical of the formula $$-(CH_2)_r-\underset{\underset{R^*}{|}}{CH}-$$

in which r is an integer from 1 to 4 and R* is alkyl having 1 to 3 carbon atoms, and $T^1$ is an amino group of the formula (4c)

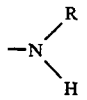

(4c)

in which

R is hydrogen or alkyl having 1 to 4 carbon atoms, which can be substituted by phenyl, sulfophenyl, amino, thio or hydroxy, or is carbamoyl, which can be mono- or disubstituted, such as, for example, by substituents from the group comprising alkyl having 1 to 4 carbon atoms, phenyl, sulfophenyl, cycloalkyl having 5 to 8 carbon atoms and alkyl having 2 to 4 carbon atoms, which is substituted by amino, thio or hydroxy, and is preferably alkyl having 1 to 4 carbon atoms, such as methyl and ethyl;

$R^{13}$ is alkoxy having 1 to 8 carbon atoms, preferably having 1 to 4 carbon atoms, such as ethoxy and methoxy, hydrogen, halogen, such as chlorine and bromine, hydroxy, alkyl having 1 to 8 carbon atoms, preferably having 1 to 4 carbon atoms, such as ethyl and methyl, alkenyl having 2 to 8 carbon atoms, preferably having 2 to 4 carbon atoms, alkinyl having 3 to 8 carbon atoms, preferably having 3 to 5 carbon atoms, or phenyl or a group of the formula (9a) or (9b) and is preferably alkyl having 1 to 4 carbon atoms, alkoxy having 1 to 4 carbon atoms, alkoxy having 2 to 4 carbon atoms which is substituted by alkoxy having 1 to 4 carbon atoms or a group of the formula (9a) or (9b), and $R^{14}$ has one of the meanings given for $R^1$ and $R^{13}$.

The present invention accordingly also relates to these novel silane compounds of the formula (8), their preparation and, as already mentioned above, their use for modifying fiber material.

Analogously to the other silane compounds of the formula (1) which can be used according to the invention, the silane compounds of the formula (8) can be prepared according to the invention, for example, by reacting a compound of the general formula (10)

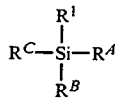

(10)

in which $R^1$ has one of the abovementioned meanings, $R^A$ is a radical of the formula (11a) or (11b)

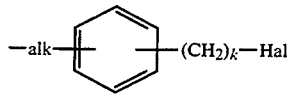

(11a)

$$-(CH_2)_n-Hal \quad (11b)$$

in which alk, k and n have one of the abovementioned meanings and

Hal represents a halogen atom, preferably a chlorine atom, $R^B$ is alkoxy having 1 to 8 carbon atoms, preferably 1 to 4 carbon atoms, such as ethoxy and methoxy, hydrogen, halogen, such as chlorine and bromine, hydroxy, alkyl having 1 to 8 carbon atoms, preferably having 1 to 4 carbon atoms, such as ethyl and methyl, alkenyl having 2 to 8 carbon atoms, preferably having 2 to 4 carbon atoms, alkinyl having 3 to 8 carbon atoms, preferably having 3 to 5 carbon atoms, or phenyl or a group of the formula (11a) or (11b), and is preferably alkyl having 1 to 4 carbon atoms, alkoxy having 1 to 4 carbon atoms, alkoxy having 2 to 4 carbon atoms which is substituted by alkoxy having 1 to 4 carbon atoms, or a group of the formula (11a) or (11b), and $R^C$ has one of the meanings given for $R^1$ or $R^B$, with a compound of the general formula (12a) or (12b)

$$MeO-(CH_2)_n-T^1 \quad (12a)$$

$$MeO-(CH_2)_p-T^1 \quad (12b)$$

in which n, p and $T^1$ have one of the abovementioned meanings and Me is an alkali metal, such as sodium and in particular potassium, in a polar, organic, optionally water-miscible solvent which is inert toward the reactants, such as, in particular, toward alcoholates, at a temperature of between 0° and 50° C., preferably between 10° and 40° C.

The starting compounds of the formula (12a) and (12b) are prepared in the customary manner by using the corresponding hydroxy compound (aminoalcohol) as the starting substance and reacting this with the metallic alkali metal, such as sodium and in particular potassium, in the abovementioned solvents in a procedure which is known per se. The reaction is as a rule carried out at a temperature between 50° and 150° C., preferably between 80° and 110° C. The solvent chosen is preferably one having a sufficiently high boiling point, so that the alkali metal can be heated to above its melting point in order to simplify and to accelerate the reaction procedure.

Solvents which are suitable for this purpose are, in particular, aliphatic hydrocarbons having a boiling range from 70° to 150° C., such as, for example, heptane and dodecane, and mixtures thereof, and furthermore aromatic hydrocarbons, such as, for example, alkyl-substituted benzenes and naphthalenes, such as, in particular, toluene and xylene, and furthermore aliphatic, in particular cycloaliphatic, ether compounds, such as, for example, tetrahydrofuran.

In the reaction according to the invention of the compound of the formula (8) with a compound of the formula (12a) or (12b), the corresponding alkali metal halide is liberated and is precipitated as a crystalline salt. It is separated off after the reaction, for example by filtration, the solvent is removed by means of fractional distillation from the mixture which has been freed from the salt and the silane compound synthesized is isolated.

Silane compounds which can be used according to the invention are, for example: [γ-(β'-amino-ethoxy)-propyl]-trimethoxy-silane, [γ-(β'-aminoethyl-amino)-propyl]-trimethoxy-silane, [γ-β'-aminoethoxy)-propyl]-methyl-diethoxy-silane, [γ-(β'-aminoethyl-amino)-propyl]-methyl-dimethoxy-silane, 3- or 4-aminophenyl-trimethoxy-silane, [γ-(4-aminophenoxy)-propyl]-trimethoxy-silane, N-[γ-(trimethoxysilyl)-propyl]-N,N-di-(β'-aminoethyl)-amine, (γ-aminopropyl)-trimethoxy-silane, (γ-aminopropyl)-ethoxy-dimethyl-silane, (γ-aminopropyl)-methyl-diethoxy-silane, N,N-bis-[γ-(triethoxy-silyl)-propyl]-amine, [γ-(N,N-dimethylamino)-propyl]-trimethoxy-silane, [γ-(N-methylamino)-propyl]-trimethoxy-silane, (δ-aminobutyl)-trimethoxy-silane, {4-[N-(β-aminoethyl)-amino]-methyl}-phenethyl-trimethoxy-silane, [(N-cyclohexyl-amino)-methyl]-methyl-diethoxy-silane, [γ-(N,N-diethyl-amino)-propyl]-trimethoxy-silane, [γ-(β'-N-methylamino-ethoxy)-propyl]-methyl-diethoxy-silane, [γ-(β'-N-methylamino-ethoxy)-propyl]-triethoxy-silane, [γ-(β'-N-methylamino-ethoxy)-propyl]-dimethyl-ethoxy-silane, 1-{3'-[β-(N-methylamino)-ethoxy-methyl]-phenyl}-eth-1-yl-(diethoxy)-(methyl)-silane, 2-{4'-[β-(N-methylamino)-ethoxy-methyl]-phenyl}-eth-2-yl-(diethoxy)-(methyl)-silane, 1-{4'-[β-(N-methylamino)-ethoxy-methyl]-phenyl}-eth-1-yl-(diethoxy)-(methyl)-silane, 2-{3'-[β-(N-methylamino)-ethoxy-methyl]-phenyl}-eth-2-yl-(diethoxy)-(methyl)-silane, {γ-[β'-(β''-aminoethyl)-aminoethyl]-propyl}-trimethoxy-silane, 1,3-di-(γ-aminopropyl)-1,1,3,3-tetramethyl-disiloxane and polyethyleneimine which has 3 to 5 ethyleneimine units and is substituted by [γ-(trimethoxy-silyl)-propyl] and/or [γ-(methyl-dimethoxy-silyl)-propyl] groups.

The textile fiber material is modified according to the invention by bringing the textile fiber material into contact with an aqueous solution of the silane compound which contains the silane in a concentration of between 0.1 and 20% by weight, preferably between 5 and 10% by weight. This silane solution can be applied to the textile fiber material by treatment in the aqueous dye liquor itself (analogously to an exhaust dyeing process) or by slop padding or spraying-on. If the fiber material is impregnated with the silane solution by introduction of the material into this solution or by slop padding (padding), excess liquor is then squeezed off from the impregnated material so that the liquor pick-up is between 50 and 120% by weight, preferably between 70 and 100% by weight, based on the weight of the fiber material. The impregnation is carried out at a temperature of between 10° and 60° C., preferably at a temperature of between 15° and 30° C. If the aqueous silane solution is applied to the fiber material by spraying, the absorption of liquid chosen is as a rule between 10 and 50% by weight.

The fiber material impregnated with the silane solution is then dried, drying as a rule being carried out at the same time as the fixing of the silane compound on the fiber material. Drying and fixing are preferably carried out at elevated temperature, for example at a temperature between 100° and 230° C., preferably between 100° and 150° C. and in particular between 110° and 135° C., it being possible for this treatment to be carried out by hot air for 2 to 5 minutes or by saturated steam. However, fixing can also be carried out by simply drying the suspended, impregnated material in drying cabinets. It is furthermore possible to carry out the fixing by initially packing the impregnated material air-tight in the moist state, if appropriate in a film, first storing it at room temperature (15° to 25° C.) or slightly elevated temperature (up to 40° C.) for up to 24 hours and then carrying out the fixing at a high temperature as described above.

Aftertreatment of the textile material modified in this way is as a rule not necessary.

Textile fiber material which is both modified according to the invention and employed in the modified form in the dyeing process according to the invention can be present in all states of processing, that is to say as yarn, flock, slubbing and piece-goods (woven fabric), and in the form of blended fiber materials, such as, for example, cotton/polyester fiber materials, such as blended woven fabrics.

The dyeing according to the invention of textile fiber materials modified in this way is carried out analogously to the known dyeing procedures and printing processes for dyeing or printing fiber materials with water-soluble textile dyestuffs, such as anionic dyestuffs, in particular fiber-reactive dyestuffs, using the temperature ranges known to be employed for this purpose and the customary amounts of dyestuff, but with the exception according to the invention that for the dyebaths, padding liquors and printing pastes of the dyeing processes according to the invention, addition of alkaline compounds such as are usually used for fixing fiber-reactive dyestuffs, such as, for example, sodium carbonate, potassium carbonate, sodium hydroxide solution and water-glass, can be substantially or even entirely excluded, and furthermore the customary addition of electrolyte salts which are intended, in particular, to increase the migration of the dyestuff to the fiber is not necessary or is necessary to only a small extent, i.e. up to not more than 10 g per liter of dyebath or dye liquor. The dyeing process according to the invention is accordingly carried out within a pH range of between 4 and 8, preferably between 4.5 and 7, and in particular in a pH range of between 5 and 6.

Dyeing processes which can be employed according to the invention are, for example, the various exhaust processes, such as dyeing on a jigger and on a winch or dyeing from a long or short liquor, dyeing in jet dyeing machines or dyeing by the cold pad-batch process or by a pad-hot steam fixing process. The customary liquor ratio of 1:3 to 1:20 can be used in the exhaust process. The dyeing temperature can be between 30° and 90° C., and is preferably at a temperature below 60° C.; as can be seen from the abovementioned use according to the invention of the cold pad-batch process, dyeing at room temperature (10° to 30° C.) is also advantageously possible.

The customary auxiliaries, such as surfactants (wetting agents ), urea, thiourea, thiodiethylene glycol, thickeners and leveling auxiliaries or auxiliaries which improve the solubility of dyestuffs in the concentrated padding liquors, such as, for example, condensation products of formaldehyde and optionally alkyl-substituted naphthalenesulfonic acids, can moreover be employed in the dyeing processes according to the invention. As a rule, however, they are not necessary in the process according to the invention, or are merely required only in very small amounts in comparison with the prior art, in particular in an amount of not more than up to 20% of that amount needed in the processes of the prior art.

All the water-soluble, preferably anionic dyestuffs, which preferably have one or more sulfo and/or carboxy groups and can contain fiber-reactive groups if appropriate, are suitable for the dyeing procedure according to the invention. In addition to the class of fiber-reactive dyestuffs, they can belong to the class of azo development dyestuffs, direct dyestuffs, vat dyestuffs and acid dyestuffs, which can be, for example, azo dyestuffs, copper complex, cobalt complex and chromium complex azo dyestuffs, copper and nickel phthalocyanine dyestuffs and anthraquinone, copper formazan and triphendioxazine dyestuffs. Such dyestuffs are described in the literature in numerous instances and are known to the expert in all cases.

Of the abovementioned dyestuffs which can be used for the dyeing process according to the invention, the fiber-reactive dyestuffs are preferably employed. Fiber-reactive dyestuffs are those organic dyestuffs which contain 1, 2, 3 or 4 fiber-reactive radicals of the aliphatic, aromatic or heterocyclic series. Such dyestuffs are described in numerous instances in the literature. The dyestuffs can belong to the most diverse dyestuff classes, such as, for example, the class of monoazo, disazo, polyazo and metal complex azo, such as 1:1 copper, 1:2 chromium and 1:2 cobalt complex monoazo and disazo dyestuffs, and furthermore the series comprising anthraquinone dyestuffs, copper and nickel phthalocyanine dyestuffs, copper formazan dyestuffs and azomethine, nitroaryl, dioxazine, triphendioxazine, phenazine and stilbene dyestuffs.

Fiber-reactive groups (radicals) in fibre-reactive dyestuffs are those which are capable of reacting with the hydroxy groups of cellulose, the amino, carboxy, hydroxyl and thiol groups of wool and silk or with the amino and possibly carboxy groups of synthetic polyamides to form a covalent chemical bond. The fiber-reactive radicals can be bonded to the dyestuff radical directly or via a bridge member; they are preferably bonded to the dyestuff radical directly or via an optionally monoalkylated amino group, such as, for example, a group of the formula —NH—, —N($CH_3$)—, —($C_2H_5$)— or —N($C_3H_5$)—, or via an aliphatic radical, such as a methylene, ethylene or propylene radical or an alkylene radical having 2 to 8 carbon atoms, which can be interrupted by one or two oxy and/or amino groups, or via a bridge member containing an amino group, such as, for example, a phenylamino group.

Fiber-reactive radicals are, for example: vinylsulfonyl, β-chloroethylsulfonyl, β-sulfatoethylsulfonyl, β-acetoxyethylsulfonyl, β-phosphatoethylsulfonyl, β-thiosulfatoethylsulfonyl, N-methyl-N-(β-sulfatoethyl-sulfonyl)amino, acryloyl, —CO—CCl=$CH_2$, —CO—CH=CH—Cl, —CO—CCl=CHCl, —CO—CCl=CH—$CH_3$, —CO—CBr=$CH_2$, —CO—CH=CH—CBr, —CO—CBr=CH—$CH_3$, —CO—CCl=CH—COOH, —CO—CH=CCl—COOH, —CO—CBr=CH=COOH, —CO—CH=CBr—COOH, —CO—CCl=CCl—COOH, —CO—CBr=CBr—COOH, β-chloro-or β-bromopropionyl, 3-phenylsulfonylpropionyl, 3-methylsulfonylpropionyl, 3-chloro-3-phenylsulfonylpropionyl, 2,3-dichloropropionyl, 2,3-dibromopropionyl, 2-fluoro-2-chloro-3,3-difluorocyclobutane-2-carbonyl, 2,2,3,3-tetrafluorocyclobutane-1-carbonyl or -1-sulfonyl, β-(2,2,3,3-tetrafluorocyclobut-1-yl)acryloyl, α- or β-methylsulfonylacryloyl, propionyl, chloroacetyl, bromoacetyl, 4-(β-chloroethyl-sulfonyl)-butyryl, 4-vinylsulfonyl-butyryl, 5-(β-chloroethyl-sulfonyl)-valeryl, 5-vinylsulfonyl-valeryl, 6-(β-chloroethyl-sulfonyl)-caproyl, 6-vinylsulfonyl-caproyl, 4-fluoro-3-nitro-benzoyl, 4-fluoro-3-nitrophenylsulfonyl, 4-fluoro-3-methylsulfonyl-4-fluoro-3-cyanobenzoyl, 2-fluoro-5-methylsulfonyl-benzoyl, 2,4-dichlorotriazin-6-yl, 2,4-dichloropyrimidin-6-yl, 2,4,5-trichloropyrimidin-6-yl, 2,4-dichloro-5-nitro- or -5-methyl- or -5-carboxymethyl- or -5-carboxy- or -5-cyano- or -5-vinyl- or -5-sulfo- or -5-mono-, -di- or -trichloromethyl- or -5-methylsulfonyl-pyrimidin-6-yl, 2,5-dichloro-4-methylsulfonyl-pyrimidin-6-yl, 2-fluoro-4-pyrimidinyl, 2,6-difluoro-4-pyrimidinyl, 2,6-difluoro-5-chloro-4-pyrimidinyl, 2-fluoro-5,6-dichloro-4-pyrimidinyl, 2,6-difluoro-5-methyl-4-pyrimidinyl, 2,5-difluoro-6-methyl-4-pyrimidinyl, 2-fluoro-5-methyl-6-chloro-4-pyrimidinyl, 2-fluoro-5-nitro-6-chloro-4-pyrimidinyl, 5-bromo-2-fluoro-4-pyrimidinyl, 2-fluoro-5-cyano-4-pyrimidinyl, 2-fluoro-5-methyl-4-pyrimidinyl, 2,5,6-trifluoro-4-pyrimidinyl, 5-chloro-6-chloromethyl-2-fluoro-4-pyrimidinyl, 2,6-difluoro-5-bromo-4-pyrimidinyl, 2-fluoro-5-bromo-6-chloro-methyl-4-pyrimidinyl, 2,6-difluoro-5-chloromethyl-4-pyrimidinyl, 2,6-difluoro-5-nitro-4-pyrimidinyl, 2-fluoro-6-methyl-4-pyrimidinyl, 2-fluoro-5-chloro-6-methyl-4-pyrimidinyl, 2-fluoro-5-chloro-4-pyrimidinyl, 2-fluoro-6-chloro-4-pyrimidinyl, 6-trifluoromethyl-5-chloro-2-fluoro-4-pyrimidinyl, 6-trifluoromethyl-2-fluoro-4-pyrimidinyl, 6-trifluoromethyl-2-fluoro-4-pyrimidinyl, 2-fluoro-5-nitro-4-pyrimidinyl, 2-fluoro-5-trifluoromethyl-4-pyrimidinyl, 2-fluoro-5-phenyl-or -5-methylsulfonyl-4-pyrimidinyl, 2-fluoro-5-carboxamido-4-pyrimidinyl, 2-fluoro-5-carbomethoxy-4-pyrimidinyl, 2-fluoro-5-bromo-6-trifluoromethyl-4-pyrimidinyl, 2-fluoro-6-carboxamido-4-pyrimidinyl, 2-fluoro-6-carbomethoxy-4-pyrimidinyl, 2-fluoro-6-phenyl-4-pyrimidinyl, 2-fluoro-6-cyano-4-pyrimidinyl, 2,6-difluoro-5-methylsulfonyl-4-pyrimidinyl, 2-fluoro-5-sulfonamido-4-pyrimidinyl, 2-fluoro-5-chloro-6-carbomethoxy-4-pyrimidinyl, 2,6-difluoro-5-trifluoromethyl-4-pyrimidinyl, 2,4-bis-(methylsulfonyl)-pyrimidin-4-yl, 2,5-bis-(methylsulfonyl)-5-chloro-pyrimidin-4-yl, 2-methylsulfonylpyrimidin-4-yl, 2-phenylsulfonylpyrimidin-4-yl, 2-methylsulfonyl-5-chloro-6-methyl-pyrimidin-4-yl, 2-methylsulfonyl-5-bromo-6-methylpyrimidin-4-yl, 2-methylsulfonyl-5-chloro-6-ethyl-pyrimidin-4-yl, 2-methylsulfonyl-5-chloro-methyl-pyrimidin-4-yl, 2-methylsulfonyl-5-nitro-6-methylpyrimidin-4-yl, 2,5,6-tris-methylsulfonyl-pyrimidin-4-yl, 2-methylsulfonyl-5,6-dimethyl-pyrimidin-4-yl, 2-ethylsulfonyl-5-chloro-6-methylpyrimidin-4-yl, 2-methylsulfonyl-6-chloropyrimidin-4-yl, 2,6-bis-(methylsulfonyl)-5-chloro-pyrimidin-4-yl, 2-methylsulfonyl-6-carboxy-pyrimidin-4-yl, 2-methylsulfonyl-5-sulfopyrimidin-4-yl, 2-methylsulfonyl-6-carbomethoxy-pyrimidin-4-yl, 2-methylsulfonyl-5-carboxy-pyrimidin-4-yl, 2-methylsulfonyl-5-cyano-6-methoxy-pyrimidin-4-yl, 2-methylsulfonyl-5-chloropyrimidin-4-yl, 2-sulfoethylsulfonyl-6-methylpyrimidin-4-yl, 2-methylsulfonyl-5-bromopyrimidin-4-yl, 2-phenylsulfonyl-5-chloro-pyrimidin-4-yl, 2-carboxymethylsulfonyl-5-chloro-6-methyl-pyrimidin-4-yl, 2,4-dichloropyrimidin-6-carbonyl or -6-sulfonyl, 2,4-dichloropyrimidin-5-carbonyl or -5-sulfonyl, 2-chloro-4-methylpyrimidin-5-carbonyl, 2-methyl-4-chloropyrimidin-5-carbonyl, 2-methylthio-4-fluoropyrimidin-5-carbonyl, 6-methyl-2,4-dichloropyrimidin-5-carbonyl, 2,4,6-trichloropyrimidin-5-carbonyl, 2,4-dichloropyrimidin-5-sulfonyl, 2,4-dichloro-6-methyl-pyrimidin-5-carbonyl or -5-sulfonyl, 2-methylsulfonyl-6-chloropyrimidin-4- and -5-carbonyl, 2,6-bis-(methylsulfonyl)-pyrimidin-4- or -5-carbonyl, 2-ethylsulfonyl-6-chloropyrimidin-5-carbonyl, 2,4-bis-(methylsulfonyl)-pyrimidin-5-sulfonyl, 2-methylsulfonyl-4-chloro-6-methylpyrimidin-5-sulfonyl- or -5-carbonyl, 2-chloroquinoxaline-3-carbonyl, 2- or 3-monochloroquinoxaline-6-carbonyl, 2- or 3-monochloroquinoxaline-6-sulfonyl, 2,3-dichloroquinoxaline-5- or -6-carbonyl, 2,3-dichloroquinoxaline-5- or -6-sulfonyl, 1,4-dichlorophthalazine- 6-sulfonyl- or -6-carbonyl, 2,4-dichloroquinazoline-7- or -6-sulfonyl or -carbonyl, 2,4,6-trichloroquinazoline-7- or -8-sulfonyl, 2- or 3- or 4-(4',5'-dichloro-pyridaz-6'-on-1'-yl)-phenylsulfonyl or -carbonyl, β-(4',5'-dichloro-pyridazin-6'-on-1'-yl)-propionyl, 3,6-dichloropyridazine-4-carbonyl or -4-sulfonyl, 2-chlorobenzothiazole-5- or -6-carbonyl or -5- or -6-sulfonyl, 2-arylsulfonyl- or 2-alkylsulfonylbenzothiazole-5- or -6-carbonyl or -5- or -6-sulfonyl, such as 2-methylsulfonyl-or 2-ethylsulfonylbenzothiazole-5- or -6-sulfonyl or -carbonyl, 2-phenylsulfonyl-benzothiazole-5- or -6-sulfonyl or -carbonyl and the corresponding 2-sulfonylbenzothiazole-5- or -6-carbonyl or -sulfonyl derivatives containing sulfo groups in the fused-on benzene ring, 2-chlorobenzoxazole-5- or -6-carbonyl or -sulfonyl, 2-chlorobenzimidazole-5- or -6-carbonyl or -sulfonyl, 2-chloro-1-methylbenzimidazole-5- or -6-carbonyl or -sulfonyl and 2-chloro-4-methyl-1,3-thiazole-5-carbonyl or -4- or -5-sulfonyl; triazine rings containing ammonium groups, such as 2-trimethylammonium-4-phenylamino- and -4-(o-, m- or p-sulfophenyl)-aminotriazin-6-yl, 2-(1,1-dimethylhydrazinium)-4-phenylamino- and -4-(o-, m- or p-sulfophenyl)-aminotriazin-6-yl, 2-(2-isopropylidene-1,1-dimethyl)hydrazinium-4-phenylamino-and -4-(o-, m- or p-sulfophenyl)-aminotriazin-6-yl, 2-N-aminopyrrolidinium- or 2-N-aminopiperidinium-4-phenylamino- or -4-(o-, m- or p-sulfophenyl)-aminotriazin-6-yl, 4-phenylamino- or 4-(sulfophenylamino)-triazin-6-yl, which contain 1,4-bis-aza-bicyclo[2.2.2] octane or 1,2-bis-aza-bicyclo-[0.3.3]-octane bonded quaternally in the 2-position via a nitrogen bond, 2-pyridinium-4-phenylamino- or -4-(o-, m- or p-sulfophenyl)-amino-triazin-6-yl and the corresponding 2-oniumtriazin-6-yl radicals which are substituted in the 4-position by alkylamino, such as methylamino, ethylamino or β-hydroxyethylamino, or alkoxy, such as methoxy or ethoxy, or aryloxy, such as phenoxy or sulfophenoxy.

Fiber-reactive radicals which are of particular interest are fluoro- and chloro-1,3,5-triazine radicals of the formula (13)

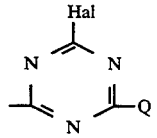

(13)

in which Hal is chlorine or fluorine and Q is an amino, alkylamino, N,N-dialkylamino, cycloalkylamino, N,N-dicycloalkylamino, aralkylamino, arylamino, N-alkyl-N-cyclohexylamino or N-alkyl-N-arylamino group or an amino group containing a heterocyclic radical, which can contain a further fused-on carbocyclic ring, or amino groups in which the amino nitrogen atom is a member of an N-heterocyclic ring, which optionally contains further heteroatoms, and hydrazino and semicarbazido groups, in which the alkyl radicals mentioned can be straight-chain or branched and of low molecular weight or higher molecular weight and are preferably those having 1 to 6 carbon atoms. Possible cycloalkyl, aralkyl and aryl radicals are, in particular, cyclohexyl, benzyl, phenethyl, phenyl and naphthyl radicals; heterocyclic radicals are in particular furan, thiophene, pyrazole, pyridine, pyrimidine, quinoline, benzimidazole, benzothiazole and benzoxazole radicals. Possible amino groups in which the amino nitrogen atom is a member of an N-heterocyclic ring are preferably radicals of six-membered N-heterocyclic compounds, which can contain nitrogen, oxygen or sulfur as further heteroatoms. The abovementioned alkyl, cycloalkyl, aralkyl and aryl radicals, the heterocyclic radicals and the N-heterocyclic rings can additionally be substituted, for example by halogen, such as fluorine, chlorine and bromine, nitro, cyano, trifluoromethyl, sulfamoyl, carbamoyl, $C_1$–$C_4$-alkyl, $C_1$–$C_4$-alkoxy, acylamino groups, such as acetylamino or benzoylamino, ureido, hydroxy, carboxy, sulfomethyl or sulfo. Examples of such amino groups which may be mentioned are: —$NH_2$, methylamino, ethylamino, propylamino, isopropylamino, butylamino, hexylamino, β-methoxyethylamino, γ-methoxypropylamino, β-ethoxyethylamino, N,N-dimethylamino, N,N-diethylamino, β-chloroethylamino, β-cyanoethylamino, γ-cyanopropylamino, β-carboxyethylamino, sulfomethylamino, β-sulfoethylamino, β-hydroxyethylamino, N,N-di-β-hydroxyethylamino, γ-hydroxypropylamino, benzylamino, phenethylamino, cyclohexylamino, phenylamino, toluidino, xylidino, chloranilino, anisidino, phenetidino, N-methyl-N-phenylamino, N-ethyl-N-phenylamino, N-β-hydroxyethyl-N-phenylamino, 2-, 3- or 4-sulfoanilino, 2,5-disulfoanilino, 4-sulfomethylanilino, N-sulfomethylanilino, 2-, 3- or 4-carboxyphenylamino, 2-carboxy-5-sulfophenylamino, 2-carboxy-4-sulfophenylamino, 4-sulfonaphth-1-yl-amino, 3,6-disulfonaphth-1-yl-amino, 3,6,8-trisulfonaphth-1-yl-amino, 4,6,8-trisulfonaphth-1-yl-amino, 1-sulfonaphth-2-yl-amino, 1,5-disulfonaphth-2-yl-amino, 6-sulfonaphth-2-yl-amino, morpholino, piperidino, piperazino, hydrazino and semicarbazido.

Q can furthermore be an amino radical of the general formula —$NR^{20}R^{21}$, in which R°is hydrogen or alkyl having 1 to 4 carbon atoms, such as methyl or ethyl, and $R^{21}$ is phenyl, which is substituted by a fiber-reactive radical of the vinylsulfone series directly or via a methylamino, ethylamino, methylene, ethylene or propylene group and which can also be substituted by 1 or 2 substituents from the group comprising methoxy, ethoxy, methyl, ethyl, chlorine, carboxy and sulfo, or $R^{21}$ is alkyl having 2 to 4 carbon atoms, such as ethyl or n-propyl, which is substituted by a fiber-reactive group of the vinylsulfone series, or is alkylenephenyl with an alkylene radical having 1 to 4 carbon atoms, the phenyl of which is substituted by a fiber-reactive radical of the vinylsulfone series, or in which R°and $R^{21}$ are both alkyl having 2 to 4 carbon atoms, such as ethyl and n-propyl, which are substituted by a fiber-reactive group of the vinylsulfone series, or in which R°and $R^{21}$ are both alkylene having 3 to 8 carbon atoms, which are interrupted by 1 or 2 oxy and/or amino groups and to which a fiber-reactive group of the vinylsulfone series is bonded in the terminal position.

Fiber-reactive groups of the vinylsulfone series are those of the general formula —$SO_2$—Y, in which Y is vinyl or is ethyl, which is substituted in the β-position by a substituent which can be eliminated under alkaline conditions, such as, for example, by chlorine, sulfato, phosphato, thiosulfato, acetyloxy, sulfobenzoyloxy and dimethylamino.

The dyeings obtainable in the manner according to the invention on the modified cellulose fiber materials require no further aftertreatment, in particular no expensive aftertreatment process incorporating washing after removal from the dyebath or after completion of the fixing of the dyestuff on the substrate. As a rule, one or more customary rinsings of the dyed substrate with warm or hot and if appropriate cold water, optionally with the use of a nonionic wetting agent, is sufficient. Treatment of the dyed substrate at the boil with a washing solution to improve the fastness properties is not necessary.

The Examples which follow serve to illustrate the invention. The parts mentioned therein are parts by weight and the percentage data are percentages by weight, unless noted otherwise. Parts by weight bear the same relationship to parts by volume as the kilogram to the liter.

Example A 67.9 parts of N-methylamino-ethanol are slowly added to 35.2 parts of potassium in 1000 parts by volume of tetrahydrofuran, the exothermic reaction being kept at a temperature of between 30° and 40° C. by external cooling.

The mixture is then heated under reflux until reaction of the potassium is complete (about 5 hours). The mixture is then cooled to about 20° C. and 190.3 parts of γ-chloro-propyl-(methyl)-(diethoxy)-silane are added, the reaction temperature being kept below 40° C., if necessary, by external cooling. When the reaction has taken place, the potassium chloride which has precipitated is filtered off and the filtrate is freed from tetrahydrofuran by distillation. The product is then subjected to vacuum distillation. The compound [γ-(β'-N-methylamino-ethoxy)-propyl]-methyl-diethoxy-silane according to the invention, of the formula

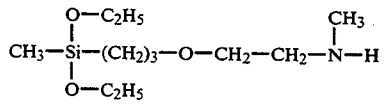

is separated off in a boiling range of between 95° and 120° C. at $5\times10^{-2}$ mbar.

$^1$H-NMR analysis: $\delta=0.06$ ppm ($CH_2$), 0.11 ppm ($Si—CH_3$) 1.25 ppm ($2\times CH_3$), 1.62 ppm ($CH_2$), 2.43 ppm ($N—CH_3$), 2.68 ppm ($CH_2$), 3.39 ppm ($CH_2$), 3.43 ppm ($CH_2$), 3.56 ppm ($2\times CH_2$).

In addition to these dominant signals, resonances with a practically identical shift occur, in a summary proportion of about 20%. From mass spectrometry analysis, these are to be assigned to polymeric ethers corresponding to a formula

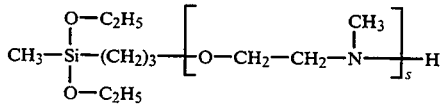

in which s is a number from 1 to 4.

Example B

To prepare a silane compound according to the invention, the procedure followed is in accordance with that of Example A, but instead of the γ-chloropropyl-methyl-diethoxy-silane compound, the equivalent amount of γ-chloropropyl-triethoxy-silane is employed. The [γ-(β'-N-methylamino-ethoxy)-propyl]-triethoxy-silane according to the invention, of the formula

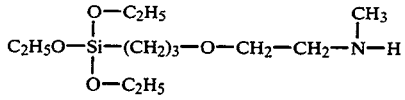

is isolated by fractional distillation in a boiling range of between 104° and 118° C. at $5\times10^{-2}$ mbar.

Example C

To prepare a silane compound according to the invention, the procedure followed is in accordance with that of Example A, but instead of the γ-chloropropyl-methyl-diethoxy-silane compound, the equivalent amount of (γ-chloropropyl)-(dimethyl)-(ethoxy)-silane is employed. The compound [γ-(β'-N-methylamino-ethoxy)-propyl]-(dimethyl)-(ethoxy)-silane according to the invention, of the formula

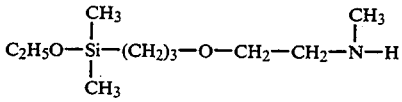

is isolated by fractional distillation in a boiling range of between 90° and 105° C. at $5\times10^{-2}$ mbar.

Example D 36.7 parts of N-methylamino-ethanol are slowly added to 20.1 parts of potassium in 700 parts by volume of tetrahydrofuran, the exothermic reaction being kept at a temperature of between 30° and 40° C. by external cooling. The mixture is then heated under reflux until the potassium has reacted completely (about 5 hours), and 147.7 parts of a mixture (in a ratio of the meta/para isomers of about 70:30) of [3'- and 4'-chloromethylphenyl-1- and -2-ethyl]-methyl-diethoxy-silane are then added at a temperature of between 20° and 35° C. When the reaction has taken place, the potassium chloride which has precipitated is filtered off and the filtrate is freed from tetrahydrofuran by distillation. The product is then subjected to vacuum distillation. The compounds according to the invention which are obtained as a mixture and correspond to the formulae

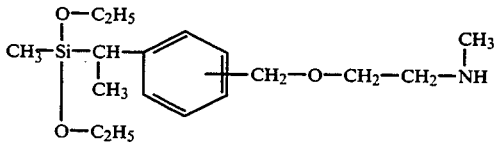

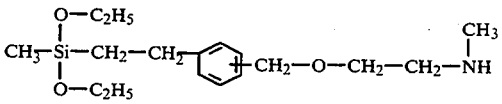

are separated off in a boiling range of between 165° C. and 200° C./10 mbar, the following fractions resulting for the four individual compounds:

1-{3'-[β-(N-methylamino)-ethoxy-methyl]-phenyl}-eth-1-yl-(diethoxy)-(methyl)-silane: boiling point: 165° C./10 mbar;

1-{4'-[β-(N-methylamino)-ethoxy-methyl]-phenyl}-eth-1-yl-(diethoxy)-(methyl)-silane: boiling point: 174° C./10 mbar;

2-{3'-[β-(N-methylamino)-ethoxy-methyl]-phenyl}-eth-2-yl-(diethoxy)-(methyl)-silane: boiling point: 185° C./10 mbar;

2-{4'-[β-(N-methylamino)-ethoxy-methyl]-phenyl}-eth-2-yl-(diethoxy)-(methyl)-silane: boiling point: 197° C./10 mbar.

EXAMPLE 1 a) A woven fabric of mercerized and bleached cotton is impregnated with a liquor pick-up of 72% with an aqueous solution, warmed to 25° to 30° C., of 80 parts of [γ-(β'-amino-ethoxy)-propyl]-trimethoxy-silane in 1000 parts of water, which is adjusted to a pH of 5.5 with glacial acetic acid. The material is then dried with hot air at 130° C. for 5 minutes and at the same time the silane compound is fixed on the material.

b) The cotton fabric modified in this way is dyed analogously to a customary exhaust dyeing process: 100 parts of the modified woven fabric are introduced into 2000 parts by volume of an aqueous dyestuff solution which contains 2 parts of a 50% strength electrolyte-containing (containing predominantly sodium chloride) dyestuff powder of the known dyestuff of the formula

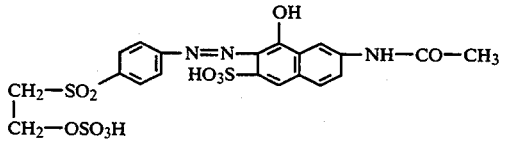

in the form of the alkali metal salt (i.e. 1 part of this dyestuff and 1 part of the electrolyte) in dissolved form, the dyebath is heated to 60° C. in the course of 30 minutes and the dyeing process is continued at this temperature for 60 minutes. The dyed woven fabric is then rinsed with cold and with hot water, it being possible for the hot water to contain a commercially available wetting agent, and if appropriate rinsed again with cold water and dried.

A deep, uniformly colored orange dyeing which has good general fastnesses is obtained.

EXAMPLE 2 a) A mercerized and bleached cotton woven fabric is padded with a liquor pick-up of 72% with an aqueous solution of 50 parts of [γ-(β'-aminoethylamino)-propyl]-trimethoxy-silane in 1000 parts of water, brought to a pH of 5.5 with glacial acetic acid, at a temperature of 25° to 30° C. The silane compound is then fixed on the cotton and the padded fabric is simultaneously dried by treatment with hot air at 130° C. for about five minutes.

b) The cotton woven fabric modified in this way is then dyed in accordance with a cold pad-batch dyeing process. For this, an aqueous dyestuff solution containing, in 1000 parts by volume, 20 parts of the dyestuff powder described in Example 1, 100 parts of urea and 3 parts of a commercially available nonionic wetting agent in dissolved form is applied to the woven fabric at 25° C. by means of a padder with a liquor pick-up of 80%, based on the weight of the woven fabric. The woven fabric padded with the dyestuff solution is wound onto a beam, encased in a plastic film, left at 20° to 25° C. for 16 hours and then rinsed with cold and with hot water, which can contain a commercially available wetting agent if appropriate, and subsequently again with cold water if appropriate and dried.

A deep, uniformly colored orange dyeing which has good general fastnesses is obtained.

EXAMPLE 3 a) A woven fabric of a commercially available polyacrylic fiber is padded with a liquor pick-up of 84%, based on the weight of the fiber material, with an aqueous solution of 50 parts of [β-(γ-aminopropyl-amino)-ethyl]-trimethoxy-silane in 1000 parts of water, brought to a pH of 5.5 with glacial acetic acid. The padded woven fabric is then exposed to a temperature of 100° C. for 5 minutes, during which both fixing of the silane compound to the material and drying of the material take place.

b) The woven fabric modified in this way is dyed in accordance with a customary padding process, for example analogously to the procedure of Example 2b. For this, an aqueous liquor containing, in 1000 parts by volume, 28 parts of a 50% strength electrolyte-containing (containing predominantly sodium chloride) dyestuff powder of the dyestuff known from Example 1 of European Patent No. 0 032 187, of the formula

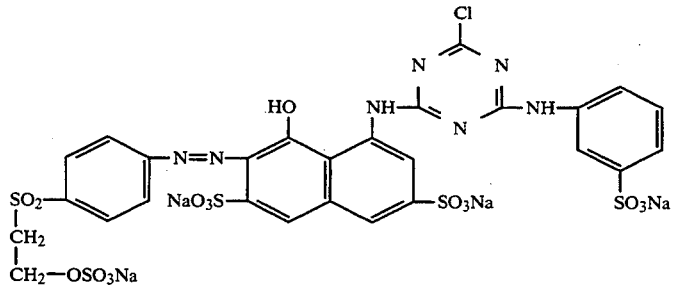

100 parts of urea and 3 parts of a commercially available nonionic wetting agent in dissolved form is applied to the woven fabric at 20° C. by means of a padder with a liquor pick-up of 80%, based on the weight of the woven fabric. The padded woven fabric is then wound onto a beam, encased in a plastic film, left at 20° C. for 16 hours and then washed with cold and with hot water, which can contain a commercially available nonionic surfactant if appropriate, and if appropriate again with cold water and dried.

A deep, uniformly colored red dyeing with the customary good fastnesses is obtained.

EXAMPLE 4 a) A woven fabric of commercially available pure silk is impregnated with the silane solution described in Example 3 with a liquor pick-up of 80% and then dried at 120° C. for 3 minutes, the silane compound being simultaneously fixed to the silk fiber.

b) The material modified in this way is dyed in a customary exhaust process. For this, 10 parts of this material are introduced into 200 parts by volume of an aqueous dyestuff solution containing 0.2 part of a 50% strength electrolyte-containing dyestuff powder of the known dyestuff of the formula

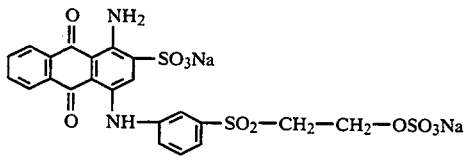

in dissolved form. Dyeing is carried out at 30° C. for 30 minutes. The dyed woven fabric is then rinsed with cold and with warm water at 30° to 35° C., which can contain a commercially available nonionic surfactant if appropriate, subsequently washed again with cold water if appropriate and dried. A deep blue dyeing which is equivalent to dyeings obtained by the customary dyeing procedures of the prior art in respect of fastness properties and their other qualities is obtained.

EXAMPLE 5 a) A woven fabric of a commercially available polyester staple fiber is padded in accordance with the information in Example 1 with the aqueous solution of the silane compound in that Example with a liquor pick-up of 95%. Drying of the material and fixing of the silane compound on the material are then carried out at 130° C. for 5 minutes.

b) The polyester woven fabric modified in this way is then dyed in an exhaust process. It is not necessary, as is customary according to the prior art for dyeing polyester fibers, for high dyeing temperatures to be employed for this purpose, and the dyeing of the modified polyester woven fabric can be carried out according to the invention with an anionic dyestuff:

100 parts of the modified polyester woven fabric are introduced into 2000 parts by volume of an aqueous dyestuff solution containing 2 parts of the dyestuff powder, described in Example 4, of the blue anthraquinone dyestuff shown in that Example in dissolved form. The dyebath is heated to 60° C. in the course of 30 minutes and the dyeing process is brought to completion at this temperature for a further 30 minutes. The dyeing removed from the dyebath is then rinsed with cold and with hot water, which can contain a commercially available nonionic surfactant if appropriate, subsequently rinsed again with warm and cold water if appropriate and dried. A deep, blue, level dyeing with good fastness properties is obtained.

EXAMPLE 6 a) A woven fabric of mercerized and bleached cotton is impregnated with a liquor pick-up of 72% with an aqueous solution, warmed to 25° to 30° C., of 80 parts of [γ-(β'-amino-ethoxy)-propyl]-methyl-diethoxysilane in 1000 parts of water, brought to a pH of 5.5 with glacial acetic acid. The material is then dried with hot air at 130° C. for 5 minutes and the silane compound is simultaneously fixed on the material.

b) The cotton woven fabric modified in this way is dyed in the procedure described in Example 1b) using the azo dyestuff shown in that Example. A deep, uniformly colored orange dyeing which has good general fastnesses is obtained.

EXAMPLE 7 a) A woven fabric of a commercially available polyacrylic fiber is padded with a liquor pick-up of 84%, based on the weight of the fiber material, with an aqueous solution of 50 parts of [γ-(β'-aminoethyl-amino)-propyl]-trimethoxy-silane in 1000 parts of water, brought to a pH of 5.5 with glacial acetic acid. The padded woven fabric is then exposed to a temperature of 100° C. for 5 minutes, both fixing of the silane compound on the material and drying of the material taking place.

b) The woven fabric modified in this way is dyed in accordance with a customary padding process, for example according to the information of Example 3b) using the azo dyestuff shown in that example. A deep, uniformly colored red dyeing with the customary good fastnesses is obtained.

EXAMPLE 8 a) A woven fabric of mercerized and bleached cotton is impregnated with a liquor pick-up of 70%, based on the weight of the cotton, with a solution of 80 parts of [γ-(β'-N-methylamino-ethoxy)-propyl]-methyl-diethoxy-silane (Example A) in 1000 parts of water, brought to a pH of 5.5 with glacial acetic acid. The woven fabric impregnated with this solution is subsequently exposed to a stream of hot air at 130° C. for 5 minutes.

b) 100 parts of the modified cotton woven fabric obtained according to section a) are introduced into 2000 parts of an aqueous solution containing about 1 part of the known monoazo dyestuff of the formula

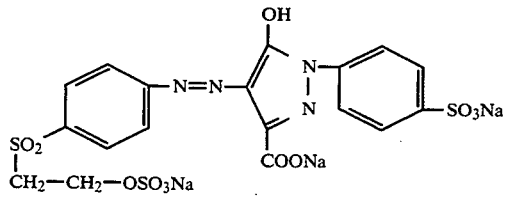

The dyebath is heated to 60° C. in the course of 30 minutes and the dyeing process is continued at this temperature for 60 minutes. The dyed woven fabric is then removed from the bath, rinsed first with cold and then with warm water at 30° to 35° C., which contains a commercially available nonionic surfactant if appropriate, and subsequently rinsed again with cold water and dried.

A deep yellow dyeing with good fastness properties, a good depth of color and a uniform appearance of the goods is obtained; the dyeing corresponds in its quality to dyeings obtained with this dyestuff by the dyeing procedures of the prior art.

EXAMPLE 9 a) A woven fabric of a commercially available mercerized cotton fiber is padded with a liquor pick-up of 80% with a solution of 80 parts of [γ-(β'-N-methylamino-ethoxy)-propyl]-triethoxy-silane in 1000 parts of water, brought to a pH of 5.5 with glacial acetic acid. The impregnated woven fabric is then exposed to a stream of hot air at 130° C. for 3 minutes, both fixing of the silane compound on the fiber material and drying of the material itself taking place.

b) The cotton woven fabric modified according to section a) is padded with a liquor pick-up of 80% with a solution, at 20° C., of 28 parts of the monoazo dyestuff known from Example 1 of European Patent No. 0 032 187 in 1000 parts of water by means of a padder, subsequently wound onto a beam, encased in a plastic film and left at 25° C. for four hours. The dyed woven fabric is then washed with cold and with hot water, which contains a nonionic surfactant if appropriate, subsequently rinsed again with cold and hot water and then dried. A deep red dyeing having good fastness properties is obtained; the dyeing corresponds in its quality to dyeings obtained with this dyestuff in accordance with the customary dyeing procedures of the prior art.

EXAMPLE 10 a) A woven fabric of mercerized and bleached cotton is padded with a liquor pick-up of 90% with a solution, warmed to 20° to 25° C. and having a pH of 5.5, of 70 parts of [γ-(β'-N-methylamino-ethoxy)-propyl]-dimethyl-ethoxy-silane in 1000 parts of water. The impregnated material is then treated with hot air at 150° C. for 2.5 minutes, both fixing of the silane compound on the woven fabric and drying thereof taking place.

b) 100 parts of the woven fabric modified according to a) are introduced into 2000 parts of an aqueous dyestuff solution of 2 parts of a 50% strength electrolyte-containing (containing predominantly sodium chloride) dyestuff powder of the monoazo dyestuff known from Example 1 of European Patent No. 0 032 187. The dyebath is heated to 60° C. in the course of 30 minutes and the dyeing process is continued at this temperature for a further 60 minutes. The resulting dyeing is removed and rinsed twice with water, it being possible for the first rinsing water to contain a commercially available surfactant, and subsequently dried. A uniformly deep red-colored woven fabric having good fastness properties which correspond to those of a dyeing with this dyestuff which has been produced by a customary dyeing process of the prior art for fiber-reactive dyestuffs is obtained.

EXAMPLE 11 a) A woven fabric of mercerized and bleached cotton is padded with a liquor pick-up of 75% with an aqueous solution, warmed to 25° to 30° C. and having a pH of 5.5, of 80 parts of an isomer mixture of compounds having the chemical structure 3'- and 4'-[β-(N-methylamino)-ethoxy-methyl]-phenethyl-(diethoxy)-(methyl)-silane (from Example D) in 1000 parts of water. The impregnated woven fabric is then exposed to a stream of hot air at 130° C. for 3 minutes, both fixing of the silane compounds to the fiber and drying of the material taking place.

b) The cotton woven fabric modified according to a) is dyed in accordance with the procedure of Example 8b). A deep, uniformly colored yellow dyeing having good fastness properties is obtained; the dyeing corresponds in its quality to dyeings obtained with this dyestuff in accordance with the customary exhaust dyeing processes for fiber-reactive dyestuffs of the prior art.

EXAMPLE 12 a) A woven fabric of mercerized and bleached cotton is impregnated with a liquor pick-up of 72% with an aqueous solution, warmed to 25° to 30° C. of 80 parts of the silane compound of Example A in 1000 parts of water, brought to a pH of 5.5 with glacial acetic acid. The material is then dried with hot air at 130° C. for 5 minutes and the silane compound is simultaneously fixed on the material.

b) The cotton woven fabric modified in this way is dyed in accordance with an exhaust dyeing procedure:

100 parts of the modified woven fabric are introduced into 2000 parts by volume of an aqueous dyestuff solution containing 2 parts of a 50% strength electrolyte-containing (containing predominantly sodium chloride) dyestuff powder of the known dyestuff of the formula

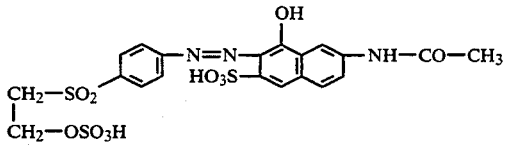

in the form of the alkali metal salt (i.e. 1 part of this dyestuff and 1 part of the electrolyte) in dissolved form, the dyebath is heated to 60° C. in the course of 30 minutes and the dyeing process is continued at this temperature for 60 minutes. The dyed woven fabric is then rinsed with cold and with hot water, it being possible for the hot water to contain a commercially available wetting agent, rinsed again with cold water if appropriate and dried.

A deep, uniformly colored orange dyeing which has good general fastnesses is obtained.

We claim:

1. In a process for dyeing a polyacrylonitrile or polyester textile fiber material or a hydroxy- or carboxyamide-groups containing textile fiber material, or a combination thereof, with a dissolved, anionic water-soluble dyestuff, the improvement which comprises applying the dissolved anionic water-soluble dyestuff to a textile fiber material which has been modified with a silane compound of the formula (I)

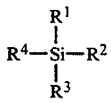

(I)

in which:

$R^1$ is alkoxy having 1 to 8 carbon atoms, hydrogen, halogen, hydroxy, alkoxy having 2 to 4 carbon atoms, which is substituted by alkoxy having 1 to 4 carbon atoms, N-morpholino, N-imidazolino or a group of the formula (2)

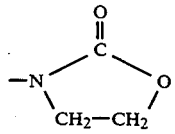

(2)

$R^2$ is a group of the formula (3a) or (3b)

$$-A-O-D'-T- \quad (3a)$$

$$\left[A-X^1\right]_a\left[B-X^2\right]_b-D-NH-G-\underset{R^9}{\overset{R^1}{Si}}-R^8 \quad (3b)$$

in which:

a is the number zero or 1;

b is zero or an integer from 1 to 10;

A is alkylene having 1 to 6 carbon atoms, which is unsubstituted or substituted by hydroxy, methoxy, ethoxy, sulfo, sulfato or carboxy, or is phenylene, which is unsubstituted or substituted by substituents from the group comprising methoxy, ethoxy, methyl, ethyl, sulfo and carboxy, or is phenylene-alkylene, alkylene-phenylene, alkylene-phenylene-alkylene or phenylene-alkylene-phenylene, in which the alkylene groups of these radicals are those having 1 to 6 carbon atoms and are unsubstituted or substituted by hydroxy, methoxy, ethoxy, sulfo, sulfato or carboxy, and the phenylene radicals are unsubstituted or substituted by substituents from the group comprising methoxy, ethoxy, methyl, ethyl, sulfo and carboxy;

$X^1$ in the case where c is 1 is a group or the formula —S—, —O—, —NH— or —N(R)—, in which R is alkyl having 1 to 4 carbon atoms, or in the case where c is 2 is a nitrogen atom;

B is cycloalkylene having 5 to 8 carbon atoms, or is alkylene having 1 to 6 carbon atoms, which is unsubstituted or substituted by hydroxy, methoxy, ethoxy, sulfato, sulfo or carboxy, or is phenylene, which is unsubstituted or substituted by substituents from the group comprising methoxy, ethoxy, methyl, ethyl, sulfo and carboxy;

$X^2$ is a group of the formula —S—, —O—, —NH— or —N(R)—, where R has the abovementioned meaning;

D' is alkylene having 1 to 6 carbon atoms unsubstituted or substituted hydroxy, methoxy, ethoxy, sulfo, sulfato or carboxy;

D is alkylene having 1 to 6 carbon atoms, which is unsubstituted or substituted by hydroxy, methoxy, ethoxy, sulfo, sulfato or carboxy, or is phenylene which is unsubstituted or substituted by substituents from the group comprising methoxy, ethoxy, methyl, ethyl, sulfo and carboxy, or is phenylene-alkylene, alkylene-phenylene, alkylene-phenylene-alkylene or phenylene-alkylene-phenylene, in which the alkylene groups of these radicals are those having 1 to 6 carbon atoms and are unsubstituted or substituted by hydroxy methoxy, ethoxy, sulfo, sulfato or carboxy, and the phenylene radicals are unsubstituted or substituted by substituents from the group comprising methoxy, ethoxy, methyl, ethyl, sulfo and carboxy, or D can be a direct bond, if (a+b) is not zero;

T is hydroxy, thiol or a group of the formula (4a) or (4b), $$N(R^5)(R^6) \quad (4a)$$

-continued $$\left[\underset{R^6}{\overset{R^5}{N}}-R^7\right]^{(+)} X^{(-)} \quad (4b)$$

in which $R^5$ is hydrogen or alkyl having 1 to 4 carbon atoms, which is unsubstituted or substituted by phenyl, sulfophenyl, amino, thio of hydroxy, or is carbamoyl or mono- or disubstituted carbamoyl, $R^6$ is hydrogen, phenyl, sulfophenyl or alkyl having 1 to 4 carbon atoms, which is unsubstituted or substituted by phenyl, sulfophenyl, methoxy, ethoxy, amino, thio or hydroxy, $R^7$ is hydrogen, alkyl having 1 to 4 carbon atoms, which is unsubstituted or substituted, and $X^{(-)}$ is a monovalent anion or a portion of a polyvalent anion equivalent to a monovalent anion;

G is a radical of the formula (5)

$$-D\left[X^2-B\right]_b\left[X^1-A\right]_a \quad (5)$$

in which D, $X^2$, B, $X^1$, A, a and b have one of the above-mentioned meanings;

$R^8$ is alkoxy having 1 to 8 carbon atoms, alkyl having 1 to 8 carbon atoms, alkenyl having 2 to 8 carbon atoms or phenylene-alkyl with an alkyl having 1 to 4 carbon atoms, in which the phenylene is unsubstituted or substituted by substituents from the group comprising methyl, ethyl, methoxy, ethoxy, sulfo and carboxy, and in which $R^8$ is unsubstituted or substituted by a group T having the above meaning;

$R^9$ has one of the meanings of $R^1$ or $R^3$;

$R^3$ is alkoxy having 1 to 8 carbon atoms, unsubstituted or substituted by alkoxy of 1 to 4 C-atoms, or is an alkyl having 1 to 8 carbon atoms and $R^4$ has one of the meanings given for $R^1$ or $R^3$, and carrying out the applying of the dissolved, water-soluble dyestuff substantially in the absence of an alkaline agent and substantially in the absence of an electrolyte, or with a combination of these measures.

2. The process as claimed in claim 1, wherein the dyestuff is a fiber-reactive dyestuff.

3. The process as claimed in claim 1, wherein the silane compound is alkoxy-substituted at the silicon.

4. The process as claimed in claim 1, wherein $R^1$ is alkoxy having 1 to 4 carbon atoms or alkoxy having 2 to 4 carbon atoms which is substituted by alkoxy having 1 to 4 carbon atoms.

5. The process as claimed in claim 1, wherein the textile is a cellulose fiber material modified with a silane compound of claim 1.

6. The process as claimed in claim 1, wherein the dyeing of the textile is carried out at a temperature of between 10° and 30° C.

7. The process as claimed in claim 1, wherein the dyeing of the textile is carried out at a temperature of between 30° and 60° C.

8. The process as claimed in claim 1, wherein the silane compound is a compound of the formula (8)

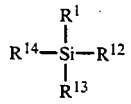

(8)

in which:

$R^1$ is alkoxy having 1 to 8 carbon atoms, hydrogen, halogen, hydroxyl, alkoxy having 2 to 4 carbon atoms, which is substituted by alkoxy having 1 to 4 carbon atoms, N-morpholino, N-imidazolino or a group of the formula (2)

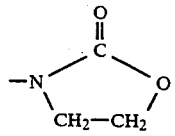

(2)

$R^{12}$ is a group of the formula (9b)

$$-(CH_2)_n\text{-}O\text{-}(CH_2)_p\text{-}_z T^1 \quad (9b)$$

in which n is an integer from 1 to 6, p is an integer from 1 to 4, z is 1, and $T^1$ is an amino group of the formula (4c)

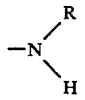

(4c)

in which

R is hydrogen or alkyl having 1 to 4 carbon atoms, which is unsubstituted or substituted by phenyl, sulfophenyl, amino, thio or hydroxyl, or is mono-or disubstituted carbamoyl;

$R^{13}$ is alkoxy having 1 to 8 carbon atoms, unsubstituted or substituted by alkoxy of 1 to 4 C-atoms, or is alkyl having 1 to 8 carbon atoms and $R^{14}$ has one of the meanings for $R^1$ or $R^{13}$.

9. The process as claimed in claim 8, wherein $T^1$ is methylamino or ethylamino.

10. A textile fiber material which is modified by a silane compound of claim 1.

11. A process for the modification of a textile fiber material, which comprises applying a silane compound as claimed in claim 1 to the textile fiber material and subjecting the material to a heat treatment of 100° to 230° C.

12. The process as claimed in claim 11, wherein the silane compound is a compound of the formula (8)

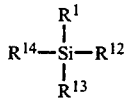

(8)

in which:

$R^1$ is alkoxy having 1 to 8 carbon atoms, hydrogen, halogen, hydroxyl, alkoxy having 2 to 4 carbon atoms, which is substituted by alkoxy having 1 to 4 carbon atoms, N-morpholino, N-imidazolino or a group of the formula (2)

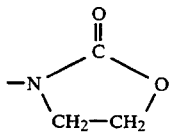

(2)

$R^{12}$ is a group of the formula [(9a) or] (9b)

$$-(CH_2)_n\text{-}O\text{-}(CH_2)_p\text{-}_z T^1 \quad (9b)$$

in which n is an integer from 1 to 6,

[m is an integer from zero to 6, k is an integer from zero to 4,]

p is an integer from 1 to 4, z is an integer from 1 to 10, and $T^1$ is an amino group of the formula (4c)

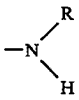

(4c)

in which

R is hydrogen or alkyl having 1 to 4 carbon atoms, which is unsubstituted or substituted by phenyl, sulfophenyl, amino, thio or hydroxy, or is mono- or disubstituted carbamoyl;

$R^{13}$ is alkoxy having 1 to 8 carbon atoms, unsubstituted or substituted by alkoxy of 1 to 4 C-atoms, or is an alkyl having 1 to 8 carbon atoms, and $R^{14}$ has one of the meanings given for $R^1$ or $R^{13}$.

13. The process as claimed in claim 12, wherein $T^1$ is methylamino or ethylamino.

14. The process as claimed in claim 11, wherein the heat treatment is carried out at a temperature of between 100° and 150° C.

15. The process as claimed in claim 1, wherein said dissolved, water-soluble dyestuff is dissolved in a padding liquor or a printing paste.

* * * * *